US009160106B2

(12) United States Patent
Kuang et al.

(10) Patent No.: US 9,160,106 B2
(45) Date of Patent: Oct. 13, 2015

(54) DELATCH MECHANISM FOR A PLUG CONNECTOR PLUGGED IN A CAGE

(71) Applicant: HON HAI PRECISION INDUSTRY CO., LTD., New Taipei (TW)

(72) Inventors: Dong-Qi Kuang, Kunshan (CN); Qing-Man Zhu, Kunshan (CN); Jerry Wu, Irvine, CA (US)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 30 days.

(21) Appl. No.: 14/091,203

(22) Filed: Nov. 26, 2013

(65) Prior Publication Data

US 2014/0148040 A1 May 29, 2014

(30) Foreign Application Priority Data

Nov. 26, 2012 (CN) ..... 2012 1 0485251

(51) Int. Cl.
*H01R 13/627* (2006.01)

(52) U.S. Cl.
CPC ..... *H01R 13/6275* (2013.01)

(58) Field of Classification Search
CPC ..... H01R 13/6275; H01R 13/627
USPC ..... 439/352, 357, 358, 350, 356, 355, 347, 439/607.01, 76.1
See application file for complete search history.

(56) References Cited

U.S. PATENT DOCUMENTS

| | | | | |
|---|---|---|---|---|
| 6,517,382 | B2 | 2/2003 | Flickinger et al. | |
| 6,916,196 | B2 | 7/2005 | Long et al. | |
| 7,281,937 | B2 | 10/2007 | Reed et al. | |
| 7,473,124 | B1 | 1/2009 | Briant et al. | |
| 7,581,978 | B1 | 9/2009 | Briant | |
| 2012/0058652 | A1 * | 3/2012 | Wang et al. | 439/76.1 |

* cited by examiner

*Primary Examiner* — Javaid Nasri
(74) *Attorney, Agent, or Firm* — Ming Chieh Chang; Wei Te Chung

(57) ABSTRACT

A delatch mechanism for a plug connector (100) plugged in a cage (20). The delatch mechanism includes a latch block (210) positioned at an exterior surface of the cage, a latch tap (14) positioned at an exterior portion of the plug connector (100), and an actuator member (3) positioned at the exterior portion of the plug connector. The latch tap has a latch hole (1421) for matching with the latch block to lock the plug connector with the cage. Drive the actuator member so that the latch block away from the latch hole to unlock the plug connector from the cage. Through setting the latch block on the cage and the latch hole on the plug connector, the delatch mechanism runs easily for unlatch process.

20 Claims, 5 Drawing Sheets

DELATCH MECHANISM FOR A PLUG CONNECTOR PLUGGED IN A CAGE

BACKGROUND OF THE INVENTION

1. Field of the Invention

The present invention relates to the field of a connector assembly with latch mechanism, more specifically to a delatch mechanism for releasing a pluggable connector from a cage.

2. Description of Related Art

U.S. Pat. No. 6,916,196, issued on Jul. 12, 2005, discloses a push button de-latch mechanism for a pluggable electronic module. The module is plugged into a receptacle which has a cage with a latch tab defining an opening. The plug module has a latching member for residing in the opening to lock the plug module with the receptacle. The plug module has an actuator slidable under a hood provided on the module housing for releasing the plug module from the receptacle.

A delatch mechanism for a plug connector plugged in a cage having an improved structure is desired.

SUMMARY OF THE INVENTION

The present invention provide a delatch mechanism for a plug connector plugged in a cage. The delatch mechanism comprises a latch block, a latch tap and an actuator member. The latch block is protruded from an exterior surface of the cage. The latch tap is held by an exterior portion of the plug connector. The latch tap defines a latch hole for matching with the latch block to latch the plug connector with the cage. The actuator member is slidably mounted on an exterior portion of the plug connector. The actuator member could slide from a first position where the latch block resides in the latch hole and the plug connector latches with the cage to a second position where a front portion of the actuator member displace the latch tap to release the latch block from the latch tab, thereby delacthing the pluggable connector from the cage. Through setting the latch block on the cage and the latch hole on the plug connector, the delatch mechanism runs easily for unlatching process.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
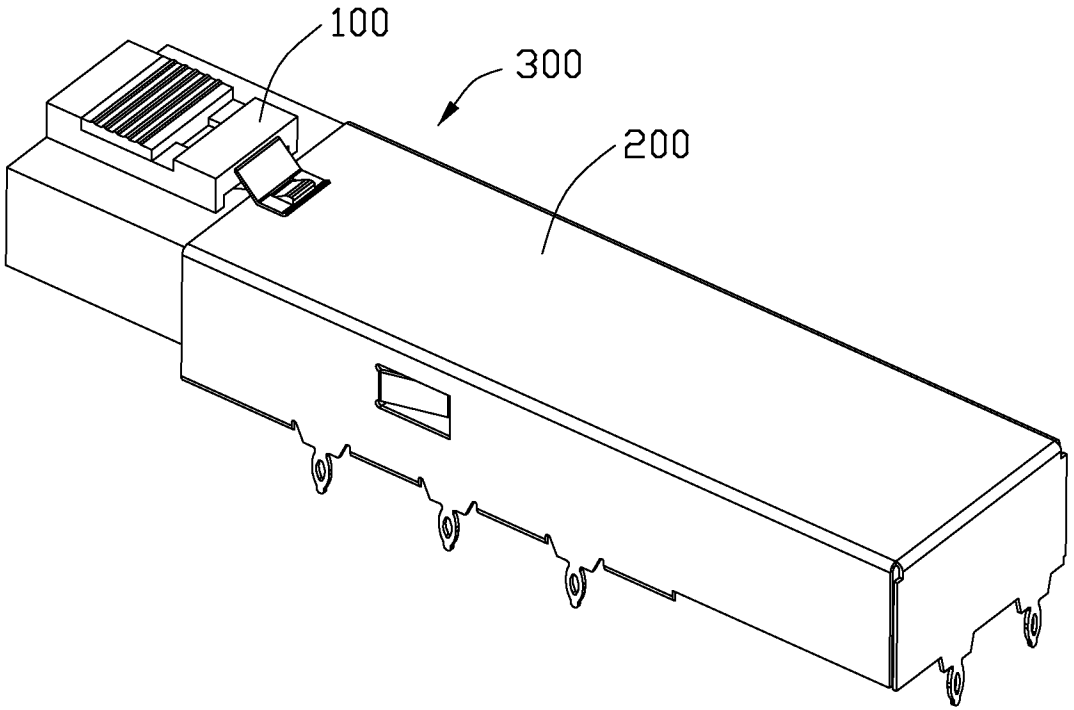
FIG. 1 illustrates a perspective view of an embodiment of a plug connector locked with a receptacle.

Referring to FIG. 1, a connector assembly 300 includes a plug connector 100 and a receptacle 200 mating with the plug connector 100.

Figure 2:
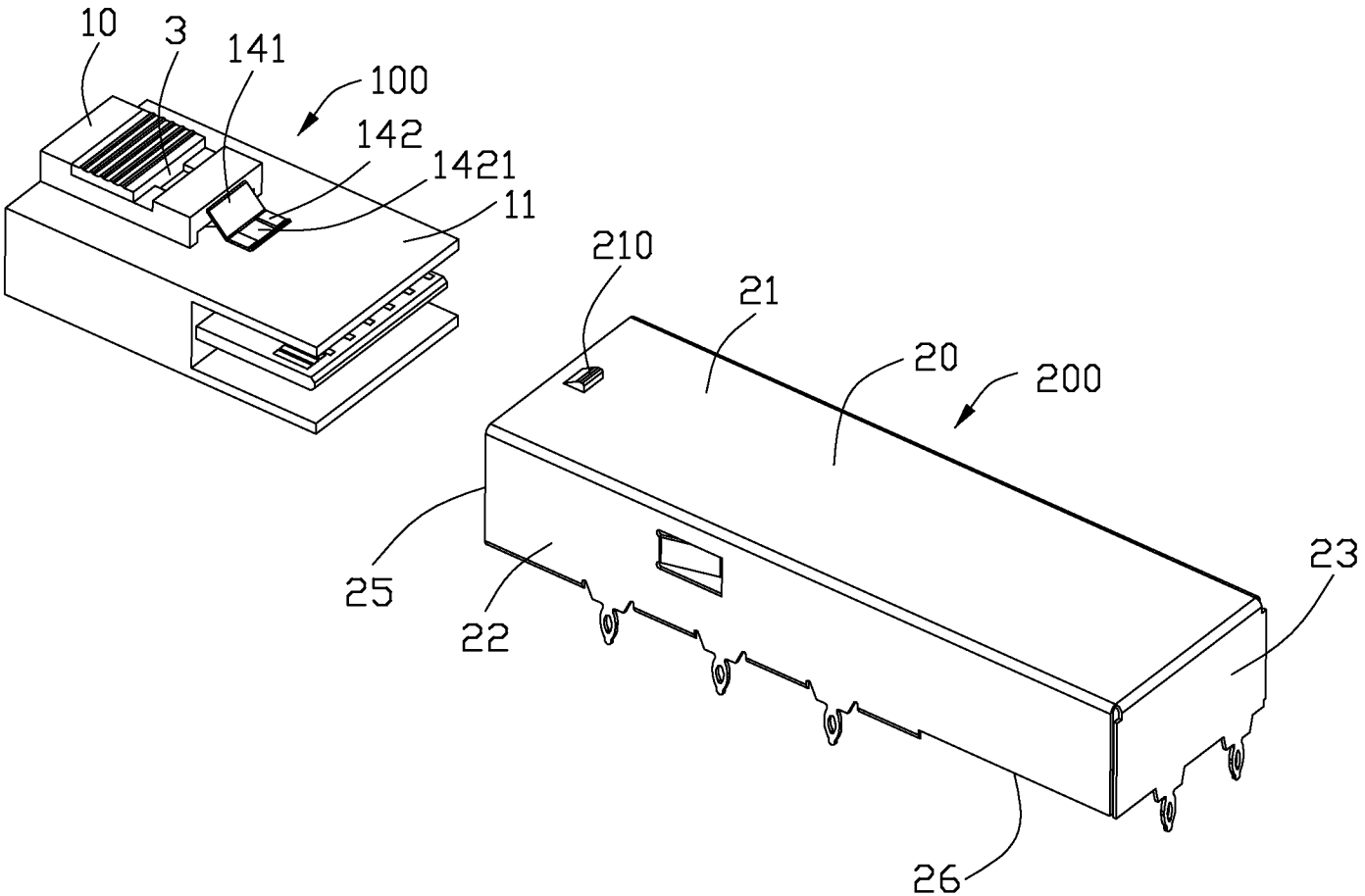
FIG. 2 illustrates a perspective view of the plug connector and the receptacle under not assembled state.

Referring to FIG. 2, the receptacle 200 has a cage 20 and an inner connector (not shown) received in the cage 20. The cage 20 includes an upper wall 21, a bottom wall, two side walls 22, and a rear wall 23. The cage 20 defines a first opening 25, a second opening 26, and a receiving room (not shown) disposed therebetween. The first opening 25 extends along a front-to-back direction and is defined by the upper wall 21, two side wall 22, and the bottom wall. The second opening 26 is disposed adjacent the rear wall 23 and extends through the bottom wall along a bottom-to-top direction. The inner connector could be inserted from the second opening 26 to the receiving room. The plug connector 100 could be inserted from the first opening 25 to the receiving room for connecting with the inner connector.

The connector assembly 300 includes a delatch mechanism for the plug connector 100 plugged in the cage 20. The cage 20 includes a latch block 210 protruded from an exterior surface of the upper wall 21 and located close to the first opening 25. The latch block 210 protrudes upwardly from the upper wall 21 and substantially shaped like a wedge. The latch block 210 has a slope gradually rising along the front-to-back direction.

Figure 3:
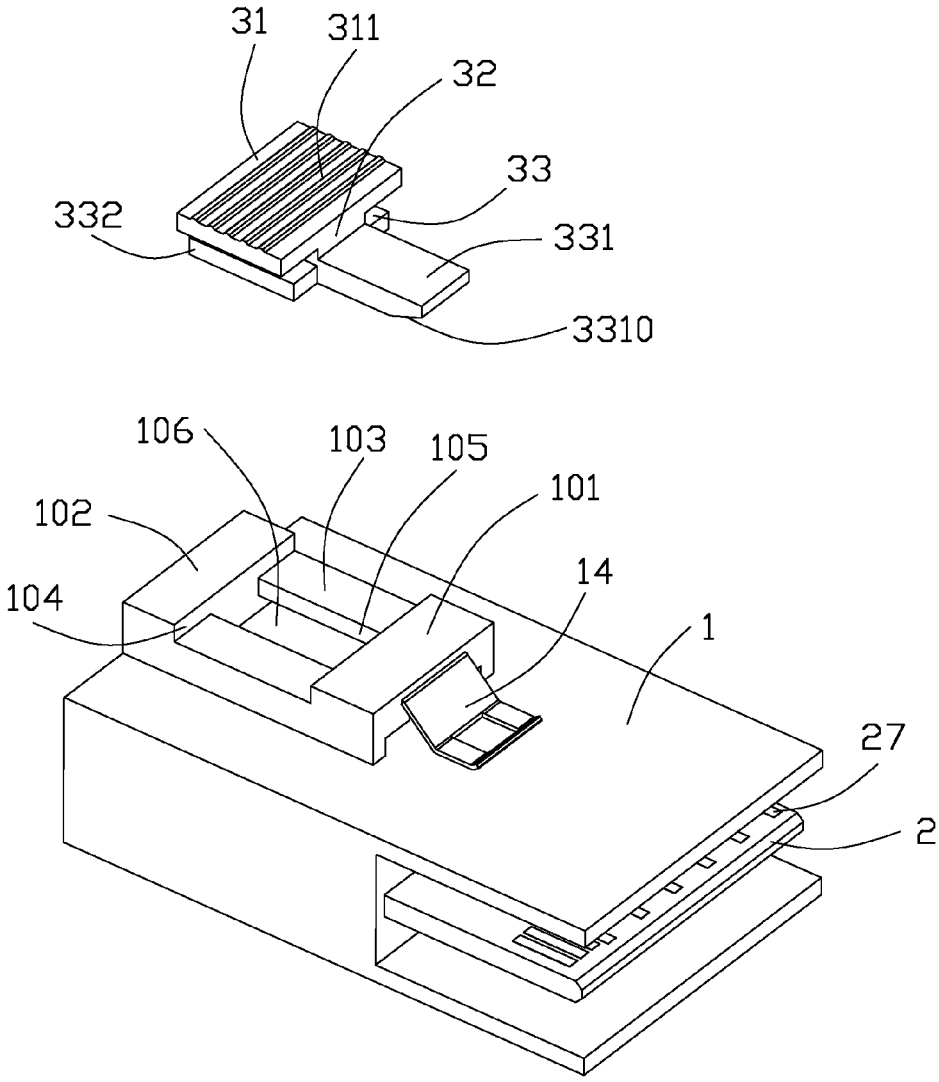
FIG. 3 illustrates an exploded view of the receptacle shown in FIG. 2.

Referring to FIGS. 2-3, the plug connector 100 has a metal die-casting shell 1, a printed circuit board 2 held by the metal die-casting shell 1, and a cable (not shown) connected to the circuit board 2. The printed circuit board 2 has a plurality of conductive pads 27 exposed to the air and disposed at a front portion of the printed circuit board 2. The inner connector has a housing and a plurality of terminals received in the housing. The conductive pads 27 could contact with the terminals after the plug connector 100 assembled to the receptacle 200.

Figure 4:
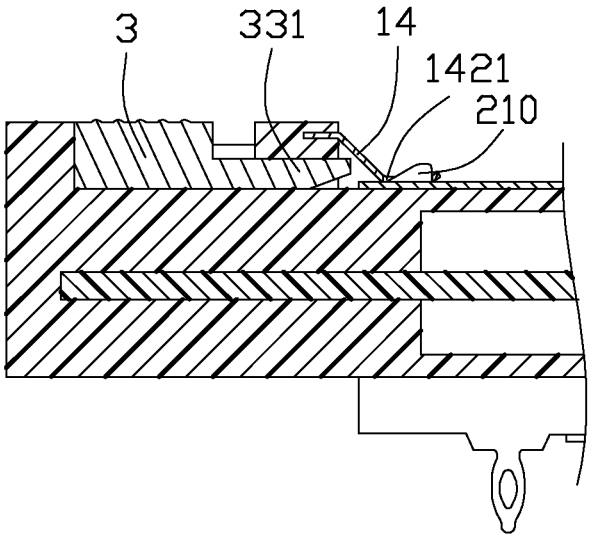
FIG. 4 illustrates a cross-sectional view of the plug connector latched with a cage of the receptacle.

The metal die-casting shell 1 has a protrusion 10 extending from a top wall 11 thereof along the bottom-to-top direction. The plug connector 100 further includes a latch tap 14 held by a front portion of the protrusion 10 and extending therefrom along a back-to-front direction. The protrusion 10 has a holding hole for the latch tap inserting and firmed (FIG. 4). The latch tap 14 is integrally formed with the protrusion 10. The protrusion 10 has a first shoulder 101, a second shoulder 102, and two concave blocks 103 located therebetween. The two concave blocks 103 defining a first passageway 106 and a second passageway 105 therebetween. A third passageway 104 is defined by the first shoulder 101, the second shoulder 102 and two concave blocks 103. The first shoulder 101 extends along a left-to-right direction and the second shoulder 102 extending parallel to the first shoulder 101. Each of the two concave blocks 103 extends along the back-to-front direction. Each of the first and second shoulders 101, 102 is higher than two concave blocks 103 along the bottom-to-top direction. The width of the first passageway 106 is bigger than the second passageway's 105 along the left-to-right direction. The width of the third passageway 104 is bigger than the second passageway's 105 along the left-to-right direction.

A delatch mechanism is set for the plug connector 100 releasing from a cage 20. The delatch mechanism includes an actuator member 3 made of plastic material. The actuator member 3 includes a sliding portion 33, a driving portion 31, and a connecting portion 32 positioned therebetween. The sliding portion 33 is received in the first passageway 106. The connecting portion 32 is received in the second passageway 105. The driving portion 31 is received in the third passageway 104 and provides a plurality of friction streaks 311 located thereon for easy pushing process. The sliding portion 33 has a front member 331 disposed at a front side of the connecting portion 32 and a rear member 332 connected with the connecting portion 32. The rear member 332 is wider than the front member 331 along the left-to-right direction. The front member 331 has a chamfer 3310 located in front of the member 331.

The latch tap 14 includes a inclined portion 141 extending forwardly and downwardly from the first shoulder 101 and a horizontal portion 142 extending from the inclined portion 141 along the back-to-front direction. The horizontal portion 142 defines a latch hole 1421 for matching with the latch block 210 to lock the plug connector 100 with the cage 20. The latch hole 1421 penetrates the horizontal portion 142 along the bottom-to-top direction. The latch hole 1421 is set as a rectangular hole. The chamfer 3310 extends substantially vertical to the inclined portion 141 so that the actuator member 3 could drive the latch tap 14 with a lower force.

Referring to FIG. 4, the lock bock 210 is received and residing in the latch hole 1421 when the plug connector 100 latched in the cage 20. The actuator member 3 is located at the rear side of the first passageway 106 in the locked state. There is a gap between the actuator member 3 and the latch tap 4 so that the actuator member 3 could not contact with the latch tap 4 in the locked state.

Figure 5:
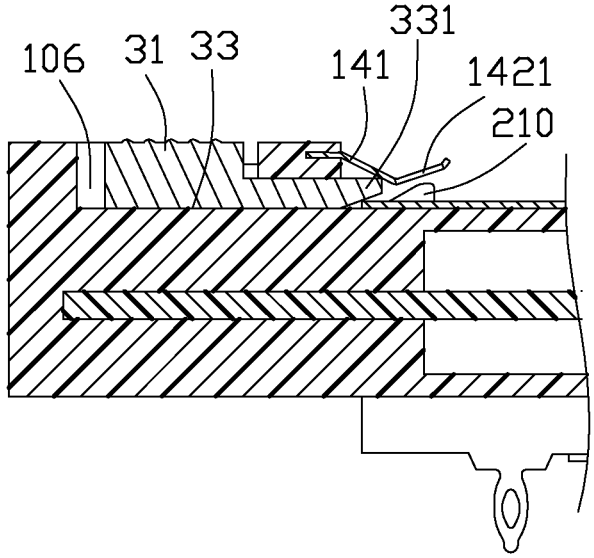
FIG. 5 illustrates a cross-sectional view of the plug connector unlocked from the cage.

Referring to FIG. 5, push the driving portion 31 of the actuator member 3 along the back-to-front direction so that the sliding portion 33 slide toward to the latch tap 4 and the front member 331 drive the declined portion 141 to lead the latch tap 4 away from the latch block 210 for unlatch. The latch tap 4 has an elastic deformation during the pushing process, therefore the actuator member 3 could be pushed to origin position by the latch tap 4 after the drive is released.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A delatch mechanism for a plug connector plugged in a cage, comprising:

a latch block protruded from an exterior surface of the cage;

a latch tap held by an exterior portion of the plug connector, the latch tap defining a latch hole for matching with the latch block to latch the plug connector with the cage; and an actuator member slidably mounted on the exterior portion of the plug connector, the actuator member being slidable from a first position where the latch block resides in the latch hole and the plug connector latches with the cage to a second position where a front portion of the actuator member displace the latch tap to release the latch block from the latch tab, thereby delacthing the plug connector from the cage.

2. The delatch mechanism for a plug connector plugged in a cage as claimed in claim 1, further comprising a protrusion protruded from an exterior surface of the plug connector, the latch tap held by a front portion of the protrusion and extending therefrom along a back-to-front direction.

3. The delatch mechanism for a plug connector plugged in a cage as claimed in claim 2, wherein said protrusion has a holding hole for the latch tap inserting and firmed.

4. The delatch mechanism for a plug connector plugged in a cage as claimed in claim 2, wherein said protrusion has a first passageway located at a rear side of the latch tap, the actuator member being limited to slide in the first passageway for pushing the latch tap to delatch the latch tap of the plug connector from the latch block of the cage, the latch tap being elastic deformed under the pushing process and the actuator member being pushed to the first position by the latch tap under a releasing process.

5. The delatch mechanism for a plug connector plugged in a cage as claimed in claim 4, wherein said protrusion has a first shoulder, a second shoulder, and two concave blocks located therebetween, the two concave blocks defining the first passageway and a second passageway therebetween, a third passageway being defined by the first shoulder, the second shoulder and the two concave blocks, the first shoulder extending along a left-to-right direction and the second shoulder extending parallel to the first shoulder, each of the first and second shoulders being higher than the two concave blocks along a bottom-to-top direction.

6. The delatch mechanism for a plug connector plugged in a cage as claimed in claim 5, wherein said actuator member includes a sliding portion, a driving portion, and a connecting portion positioned therebetween, the sliding portion received in the first passageway, the connecting portion received in the second passageway, the driving portion received in the third passageway.

7. The delatch mechanism for a plug connector plugged in a cage as claimed in claim 6, wherein the driving portion provides a plurality of friction streaks located thereon for easy pushing process.

8. The delatch mechanism for a plug connector plugged in a cage as claimed in claim 6, wherein the sliding portion has a front member disposed at a front side of the connecting portion and a rear member connected with the connecting portion, the rear member being wider than the front member along the left-to-right direction.

9. The delatch mechanism for a plug connector plugged in a cage as claimed in claim 8, wherein the front member has a chamfer located in front of the front member.

10. The delatch mechanism for a plug connector plugged in a cage as claimed in claim 9, wherein the latch tap has a inclined portion extending from the first shoulder and a horizontal portion extending from the inclined portion along the back-to-front direction.

11. The delatch mechanism for a plug connector plugged in a cage as claimed in claim 10, wherein the chamfer extends substantially vertical to the inclined portion.

12. An unlocking mechanism assembly comprising:

a metallic cage formed by sheet metal and defining therein a receiving space communicating with an exterior via a front opening in a front-to-back direction;

a locking block outwardly protruding on the cage around said opening in a vertical direction perpendicular to said front-to-back direction;

a plug connector defining opposite front ad rear portions in the front-to-back direction, said front portion received in the receiving space while said rear portion exposed outside of the cage;

a locking tap formed around a front area of the rear portion to grasp the locking block and deflectable in the vertical direction; and an actuator member located on the rear portion behind the locking tap; wherein said actuator member is back and forth movable in the front-to-back direction to outwardly deflect the locking tap to disengage the locking tap from the locking block, thus allowing rearward withdrawal of the plug connector from the cage in the front-to-back direction.

13. The unlocking mechanism assembly as claimed in claim 12, wherein when the actuator member moves forward toward the locking block, the locking tap is outwardly deflected to be released from the locking block.

14. The unlocking mechanism assembly as claimed in claim 12, wherein said actuator member defines two spaced plates in the vertical direction to receive a concave block therebetween so as to restrict movement of the actuator member relative to the plug connector in the vertical direction.

15. The unlocking mechanism assembly as claimed in claim 12, wherein the locking tap cooperate with an exterior face of the plug connector to sandwich a wall of the cage in the vertical direction.

16. The unlocking mechanism assembly as claimed in claim 12, wherein the locking tap includes a locking hole in a front section to receive the locking block therein, and an oblique section located behind the locking hole and adapted to be confronted by a front end of the actuator member for outward deflection of the locking tap.

17. The unlocking mechanism assembly as claimed in claim 12, wherein the locking tap extends in a cantilevered manner with thereof a free end facing toward the cage.

18. An unlocking mechanism comprising:

a moveable part adapted to be mated with an immoveable part via a mating opening, a front portion of the movable part being adapted to be mated with the immovable part while a rear portion of the moveable part being exposed outside of the immovable part without direct mating;

a locking block formed on the immovable part around the mating opening;

a locking tap formed on the movable part around a joined area of said front portion and said rear portion, said locking tap defining a locking head to engage the locking block, and an actuating portion behind the locking head; and an actuator member located on the rear portion of the movable part behind the locking tap; wherein the actuator member is back and forth moveable in a front-to-back direction while the locking tap is actuated by the actuator member at the actuating portion to move in a swinging manner including along a vertical direction perpendicular to said front-to-back direction.

19. The unlocking mechanism as claimed in claim 18, wherein a front end of the actuator member is tapered to comply with a configuration of the locking lock thereabouts.

20. The unlocking mechanism as claimed in claim 18, wherein the locking tap extends in a cantilevered manner with a free end facing toward the immovable part.

* * * * *